US006071026A

United States Patent [19]

Martinez et al.

[11] Patent Number: 6,071,026

[45] Date of Patent: Jun. 6, 2000

[54] RIBBON CASSETTE WITH COAXIAL SPOOLS ON COMMON SHAFT WITH PARTITIONING PLATE FOR PREVENTING CONTAMINATION

[75] Inventors: Phillip M. Martinez, Groton; Scott J. Longrod, Lansing, both of N.Y.

[73] Assignee: Axiohm Transaction Solutions, Inc., Blue Bell, Pa.

[21] Appl. No.: 09/286,330

[22] Filed: Apr. 5, 1999

Related U.S. Application Data

[63] Continuation-in-part of application No. 09/130,598, Aug. 7, 1998.

[51] Int. Cl.[7] ..... B41J 35/28

[52] U.S. Cl. ..... 400/208; 242/345.1; 242/615.21; 400/206.3

[58] Field of Search ..... 400/206.3, 206.4, 400/207, 208, 208.1; 242/345.1, 615.21

[56] References Cited

U.S. PATENT DOCUMENTS

| | | | |
|---|---|---|---|
| 3,804,227 | 4/1974 | Cappotto et al. | 400/208 |
| 4,413,919 | 11/1983 | Applegate et al. | 400/208 |
| 4,467,976 | 8/1984 | Bogaczyk et al. | 400/208 |
| 4,650,351 | 3/1987 | Engle et al. | 400/207 |
| 4,668,961 | 5/1987 | Hiramatsu | 400/323 |
| 5,152,621 | 10/1992 | Tsuji | 400/208 |
| 5,529,409 | 6/1996 | Graverholt et al. | 400/208 |

*Primary Examiner*—John S. Hilten
*Assistant Examiner*—Leslie J. Grohusky
*Attorney, Agent, or Firm*—Salzman & Levy

[57] ABSTRACT

A compact ribbon cassette for dispensing and storing a ribbon or tape. The supply and take-up rolls of ribbon or tape are disposed upon a common rotatable shaft mounted for rotation within the housing. A unique chevron disposed adjacent the take-up roll and on the post-printing portion of the cassette causes the dispensed ribbon to change level and reverse direction and be presented for storage upon the take-up roll. A partitioning plate in the ribbon cassette separates the supply roll from the take-up region of the cassette. Ink particles are thereby prevented from migrating from the post-printing, take-up region of the cassette to the pre-printing, supply region thereof.

18 Claims, 4 Drawing Sheets

RIBBON CASSETTE WITH COAXIAL SPOOLS ON COMMON SHAFT WITH PARTITIONING PLATE FOR PREVENTING CONTAMINATION

RELATED PATENT APPLICATION

This application is a continuation-in-part of the co-pending parent U.S. patent application, Ser. No. 09/130,598, filed Aug. 7, 1998, entitled COMPACT RIBBON CASSETTE. The teachings of the parent application are incorporated herein by reference.

FIELD OF THE INVENTION

The present invention relates to ribbon cassettes for storing and dispensing ribbon tapes and, more particularly, to an improved ribbon cassette containing a printing ribbon that is both dispensed from and stored upon a common rotative shaft. A ribbon level change chevron is located on the post-printing portion of the cassette to eliminate ink contamination during printing of the MICR characters. The cassette has an inner partition plate placed between the supply and take-up rolls, thereby forming a separate compartment at the post-printing portion of the cassette to minimize contamination of the fresh, unused ribbon by any flakes of ink generated at the level-change chevron.

BACKGROUND OF THE INVENTION

In the field of modern Point-of-Sale (POS) transaction printers, the objective is to provide simple, compact machines that are easy both to operate and to load. Axiohm Corporation, the assignee of the present invention, has pioneered the use of drop-loading paper supply rolls and clamshell receipt printers.

To save space and to provide faster transaction processing times for customers, many operations heretofore performed on separate pieces of equipment or performed after the actual sales transaction, have been combined into the POS transaction printer. One such feature permits encoding Magnetic Ink Character Recognition (MICR) symbols onto the Amount field of a customer's check presented in payment for goods or services. MICR encoding requires a high-quality, specialized printer ribbon incorporating magnetic particles which, after deposition on the check, allow magnetization and subsequent reading of the MICR characters.

In order to save space and provide easier ribbon loading in the MICR printing devices, the invention of the aforementioned co-pending U.S. patent application, Ser. No. 09/130,598, proposed to provide a cassette containing a MICR printing ribbon that is both dispensed and stored upon a common rotative shaft. The compact ribbon cassette replaced cassettes having spaced-apart, individual dispensing and storage rolls that divided the dispensing and storage functions.

The aforementioned, prior application described a new style of ribbon cassette for POS printers incorporating a MICR encoder, that vertically stacked the supply roll upon the take-up roll. The supply and take-up rolls were supported upon a common shaft that was rotatively supported within the cassette housing.

The ribbon cassette had a cover plate that contained integrally formed leaf springs designed to bear upon a friction plate disposed over the wound supply-ribbon spool. These leaf springs provided biasing against the friction plate, which in turn caused frictional loading of the wound supply ribbon. The friction exerted upon the supply ribbon by the friction plate maintained a tension upon the supply roll of ribbon, so that the ribbon was kept taught as it was dispensed from the supply roll. This eliminated loosely formed intervals in the ribbon as it was dispensed.

A uniquely formed chevron, disposed adjacent the supply and take-up rolls, allowed for the ribbon direction to be reversed from the supply roll to the take-up roll and shifted the level of the ribbon from the lower supply spool to the upper take-up spool. Each roll was rotated in a counter-clockwise direction, wherein the ribbon was dispensed from the lower, supply roll, then reversed direction, and was then wound upon the upper, take-up roll.

It has been discovered that the MICR printing ribbon that glides over the ribbon level changing chevron becomes wiped of its ink, especially near the edges of the ribbon. The wiped ink may be deposited upon the chevron, and may eventually flake off. These flaked ink particles can be randomly deposited upon the print line near the MICR characters, thereby causing MICR read errors.

The present invention reflects the discovery that changing the cassette construction reduces or eliminates the possibility of flaked magnetic ink being deposited upon the printed MICR line. The improved cassette now features a chevron that is located in the post-printing portion of the cassette. Now, if any flaking occurs upon the chevron, it does so after the ribbon has passed through the print window. Therefore, the flaking becomes inconsequential with respect to the printed MICR character quality. However, the flaked ink particles must still be prevented from migrating across the cassette from the post-printing portion to the pre-printing portion. In order to prevent this migration, the pre-printing portion of the cassette is constructed so as to form a sealed chamber. This sealed chamber is created by a plastic partition disposed between the post-printing portion and pre-printing portion of the cassette.

As a further precaution against migrating ink particles, the newly designed cassette also contains a wiper pad to remove any stray ink particles from the ribbon before they and it enter the print window.

SUMMARY OF THE INVENTION

In accordance with the present invention, there is provided a ribbon cassette for supplying a printing ribbon for printing MICR characters in a POS transaction printer. The ribbon cassette is constructed with both a supply roll and a take-up roll supported about a common, rotatable shaft. The rotatable shaft is rotatively mounted in the cassette housing. The supply roll and the take-up roll rotate in the same direction about the rotative shaft. A uniquely formed chevron, located on the post-printing portion of the cassette, allows for the ribbon direction to be reversed and the level of the ribbon changed. The level change is necessary in order for the supply roll and take-up roll to be compatibly disposed co-axially for rotation upon the common shaft. On the post-printing portion of the cassette, any flaking that occurs upon the level changing chevron will be of minimal consequence, because the ribbon has already been expended in the MICR encoding operation. The flaked ink particles, however, are prevented from migrating across the cassette, from the post-printing portion to the pre-printing portion, by a partition that seals the storage chamber. The partition is disposed between the post-printing portion and the pre-printing portion of the cassette. The partition prevents ink from migrating from the post-printing portion of the cassette to the pre-printing portion of the cassette and onto the fresh, unused ribbon. A wiper pad disposed adjacent the ribbon entering the print window, effectively removes any stray ink particles that may have found their way to the ribbon in the pre-printing, supply area.

It is an object of the invention to provide an improved ribbon cassette.

It is another object of this invention to provide a ribbon cassette that has a partition between supply and take-up rolls that are arranged about a common rotative shaft.

It is a further object of the invention to provide a ribbon cassette, the ribbon level change chevron of which is located within the ribbon storage chamber.

It is yet another object of this invention to prevent ink particles from migrating from the post-printing portion of the cassette to the pre-printing portion of the cassette by means of an inner partition plate.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numbering and designations throughout the figures.

DESCRIPTION OF THE PREFERRED EMBODIMENT

Generally speaking, the invention comprises a compact ribbon cassette for dispensing and storing a ribbon or tape upon co-axial, integrally formed supply and take-up rolls. The supply and take-up rolls are disposed upon a common rotatable shaft mounted for rotation within the housing. A unique chevron contained within the storage compartment causes the dispensed ribbon to change levels and to reverse direction and be presented for storage upon the take-up roll.

Figure 1:
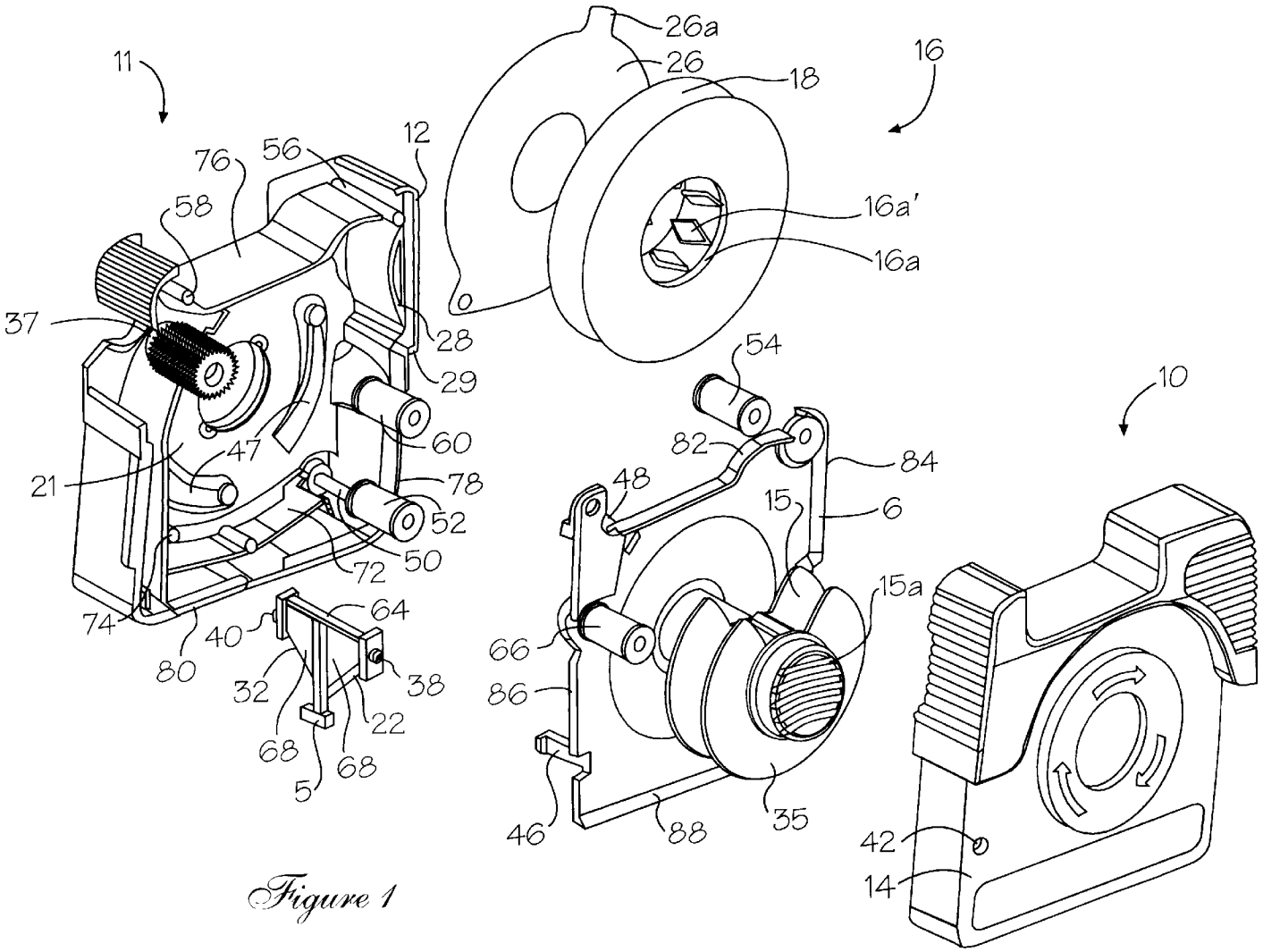
FIG. 1 illustrates a schematic, perspective, exploded, frontal view of the improved ribbon cassette of this invention.
Figure 2:
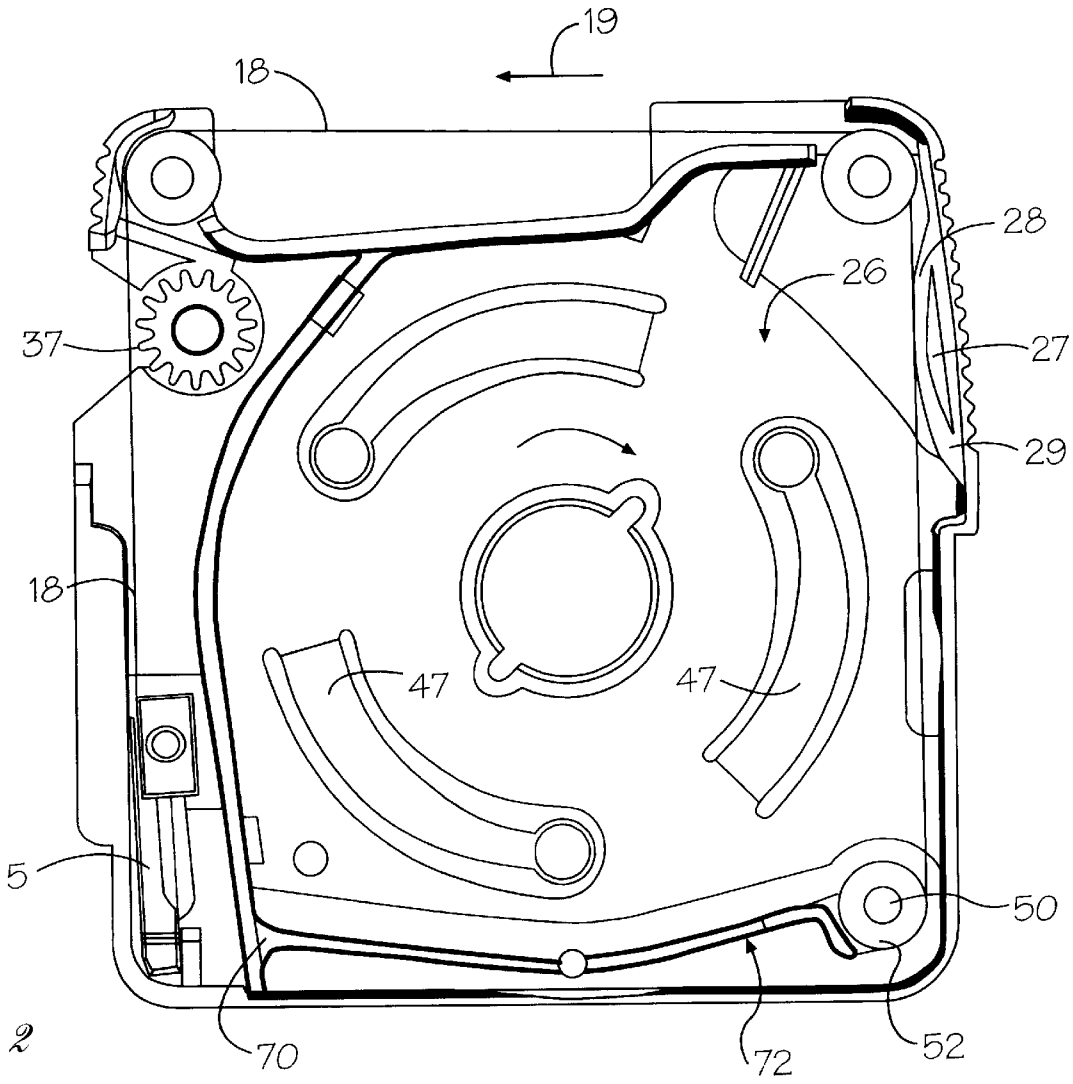
FIG. 2 depicts a schematic, plan view of the ribbon cassette, shown in FIG. 1.
Figure 3:
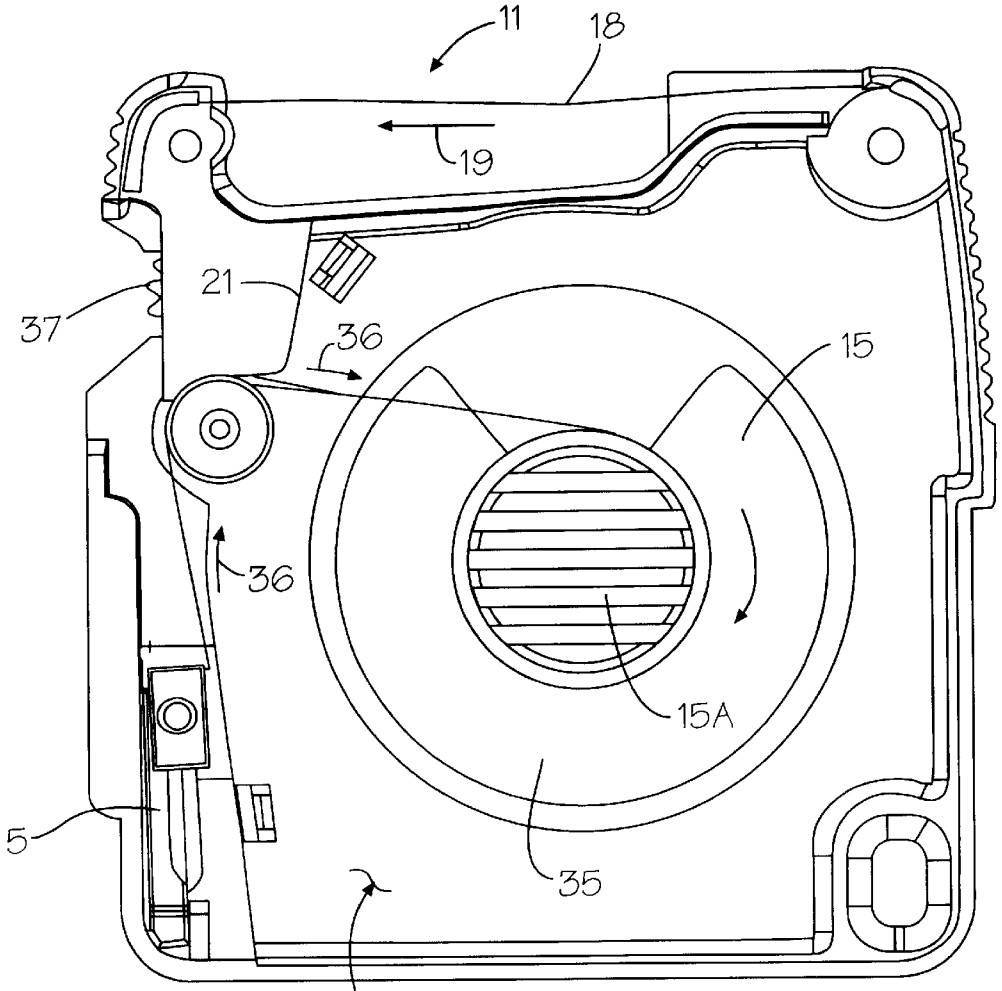
FIG. 3 shows a schematic, cut-away view of the ribbon cassette, illustrated in FIG. 2.

Now referring to FIGS. 1, 2 and 3, the ribbon cassette 10 of this invention is illustrated in various views, including an exploded, perspective view. The ribbon cassette 10 comprises a housing 12 having a cover 14. A supply roll 16 has a print ribbon 18 wound thereupon, forming a pancake assembly. The supply roll 16 is free to rotate upon the lower portion (not shown) of a take-up spool 15.

Supply pancake assembly 16 comprises a core 16*a* and the ribbon 18, and is located immediately below a partitioning plate 6 and a take-up spool 15. Pancake assembly 16 has an inner diameter with a spline 16*a*' that mates with roll or shaft 15*a*. The spline 16*a*' is used in conjunction with appropriate constraining devices, not shown, to prevent rotation during shipping and handling. To prevent adhesive from migrating or oozing from the interface between core 16*a* and ribbon 18, a paper washer or other suitable low friction material, not shown, can be placed on both sides of the pancake assembly 16. A friction plate 26 with a protrusion 26*a* also prevents rotation of the pancake assembly 16 relative to the housing 12 both during shipping and during operation of the printer and cassette 10.

Detents 46 and 48 on partitioning plate 6 snap into apertures, not shown, in the housing 12 or inner wall 74. The upper edge 82 of the partitioning plate 6 lines up with the upper edge 76 of the housing 12. The sides 84 and 86 of the partitioning plate 6 line up with the side 78 and inner wall 74 of the housing 12, respectively. The bottom edge 88 of the partitioning plate 6 lines up with bottom edge 80 of housing 12. With all four walls of housing 12 lined up and in contact with partitioning plate 6, the supply roll 16 is isolated from the rest of the cassette. Ribbon 18 passes around the inner wall 74 but, at this point, it has already been used and moves towards the take-up spool 15 to be wound thereon. Partitioning plate 6 thereby effectively isolates the ribbon 18 in the post-printing chamber of the cassette 10 from the fresh, unused ribbon 18 in the pre-printing chamber of cassette 10. Flakes of ink which occur immediately after printing or at the chevron 5, therefore, will not be able to pass into the pre-printing portion of the cassette 10.

The supply roll 16 is biased against the partitioning plate 6 by the spring fingers 47 acting on friction plate 26. The spring fingers 47 apply a predetermined amount of force on the friction plate 26, thereby, causing the friction plate 26 to exert tension or drag on the supply roll 16, pushing the supply roll 16 up against the partitioning plate 6. This novel construction exerts the appropriate amount of force on the supply roll 16 to maintain uniform pre-printing tension on the ribbon 18, thereby assuring optimum tension for good print quality. The spring fingers 47 provide a constant force on the ribbon supply roll 16, independent of the amount of ribbon 18 remaining on supply roll 16.

Tension is also applied to the pre-printing portion of ribbon 18 by a ribbon tensioning roller 52 on tensioning arm 72. Ribbon tensioning arm 72 is disposed below the supply roll 16 and is anchored at point 70 to inner wall 74 of housing 12, thereby allowing the ribbon tensioning arm 72 to flex. This removes any post-printing slack in the ribbon 18 caused by movement of the printhead (not shown) away from the print platen (not shown).

A lower right pivot pin 50 is operatively connected to the ribbon tensioning arm 72. Roller 52 is rotatively attached to the lower right pivot pin 50. When the ribbon 18 moves off the supply roll 16 and around the lower right roller 52, the ribbon 18 exerts an upward force on the ribbon tensioning arm 72. The ribbon tensioning arm 72, by design, exerts a counteracting, downward force on the ribbon 18 looped around the lower right roller 52, thereby reducing slack in the ribbon 18 when the MICR printhead, not shown, is retracted.

The printing ribbon 18 is fed past (arrow 19) the printing window 11 into a lower storage cavity 21. A chevron 5, part of which is disposed in lower storage cavity 21, adjacent the supply roll 16 and part of which is disposed on the other, upper side of the partitioning plate 6, adjacent the take-up spool 15, reverses the direction and the level of the printing ribbon 18, as previously described in the aforementioned parent patent application. The ribbon 18 rides over the lower diagonal surface 32, and is then guided over the upper diagonal surface 22 of chevron 5. In so traversing the lower and upper surfaces 32, 22 of the chevron 5, the ribbon 18 is caused to reverse direction and change level. The reversed, level-shifted printing ribbon 18 is now fed (arrow 36) between locating flanges 35 of take-up spool 15, as shown in FIGS. 1 and 3.

The chevron 5 is affixed between the cover 14 and the housing 12, by means of upper and lower tenons 38 and 40, respectively. The upper tenon 38 fits into mortise 42 in the cover 14; the lower tenon 40 fits into a similar mortise (not shown) in the housing 12.

The used ribbon 18 is guided to the take-up spool 15 through two meshing gears, only one of which is shown and identified as reference numeral 37. Gear 37 mates with an external gear (not shown) to provide positive ribbon drive. These meshing gears positively capture the used ribbon 18, thus causing the ribbon 18 to be positively advanced without slippage along its passage through the cassette 10 to the take-up spool 15.

A felt wiper pad 27 (FIG. 2) is disposed within the slots of abutments 28 and 29. The advancing print ribbon 18 is guided past the wiper pad 27 in order to remove any extraneous ink particles from the ribbon 18 prior to its transit past print window 11.

Figure 4:
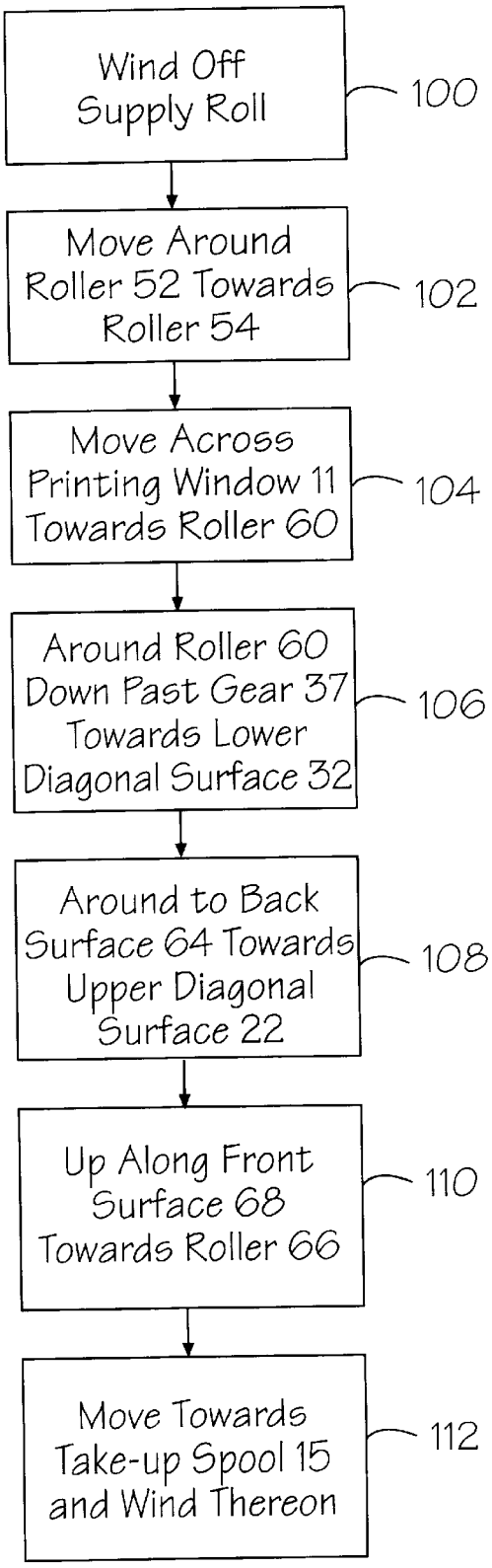
FIG. 4 is a flow chart of the path of travel of the ribbon.

Now referring also to FIG. 4, the path of travel of the ribbon 18 is described in detail. The ribbon 18 first winds off the supply roll 16 in a clockwise direction, step 100. The ribbon next moves around the lower right roller 52, rotatively connected to the lower right pivot pin 50. Then the ribbon 18 moves towards the upper right roller 54, rotatively connected to the upper right support shaft 56, step 102. Next, the ribbon 18 moves past the print window 11, step 104. After passing across the print window 11, the ribbon 18 moves around the upper left roller 60, rotatively connected to the upper left support shaft 58, down past the gear 37, and along the front surface 68 of the chevron 5, step 106. Now, the ribbon 18 moves around the lower diagonal surface 32 to the back surface 64 until it reaches the upper diagonal surface 22, step 108, and then proceeds up the front surface 68 of the chevron 5 towards the left roller 66, rotatively connected to the left support shaft, step 110. From this point, the ribbon 18 moves onto the take-up spool 15 and winds in a clockwise direction thereon, step 112.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A ribbon cassette, comprising:

a housing supporting a rotatable shaft for rotation therein;

a supply roll of ribbon mounted in a supply region of said housing for rotation upon said rotatable shaft, said supply roll dispensing a quantity of ribbon;

a take-up roll for storing ribbon dispensed by said supply roll of ribbon, said take-up roll mounted in a take-up region of said housing upon said rotatable shaft above said supply roll;

a chevron disposed in said take-up region of said housing adjacent said take-up roll for changing direction and level of ribbon dispensed from said supply roll, whereby said take-up roll is able to store the dispensed ribbon of said supply roll; and isolating means disposed between said supply and take-up regions of said housing for preventing migration of loose ink particles from said take-up region into said supply region of said housing.

2. The ribbon cassette as recited in claim 1, wherein said isolating means comprises a partitioning plate.

3. The ribbon cassette as recited in claim 2, wherein said partitioning plate comprises attachment means for securing said partitioning plate to said housing.

4. The ribbon cassette as recited in claim 3, wherein said attachment means for securing said partitioning plate to said housing comprises releasable attachment means.

5. The ribbon cassette in accordance with claim 3, wherein said supply roll is disposed on said rotatable shaft.

6. The ribbon cassette in accordance with claim 5, further comprising a meshing gear disposed within said housing, said meshing gear adapted to cooperate with an external meshing gear, said meshing gear receiving ribbon dispensed by said supply roll and passing said ribbon to said take-up roll, whereby said meshing gears cause the ribbon to be positively advanced without slippage in its passage through the cassette.

7. A ribbon cassette, comprising:

a housing supporting a rotatable shaft for rotation therein;

a supply roll of ribbon in a supply region of said housing and a take-up roll in a take-up region of said housing, both of said rolls being commonly mounted for rotation upon said rotatable shaft, said supply roll dispensing a quantity of ribbon to said take-up roll;

a chevron disposed in said housing adjacent said take-up roll and said supply roll for changing direction and level of ribbon dispensed from said supply roll, whereby said take-up roll stores the dispensed ribbon of said supply roll; and isolating means disposed between said supply and take-up regions of said housing for preventing migration of loose ink particles from said take-up region into said supply region of said housing.

8. The ribbon cassette as recited in claim 7, wherein said isolating means comprises a partitioning plate.

9. The ribbon cassette as recited in claim 8, wherein said partitioning plate comprises attachment means for securing said partitioning plate to said housing.

10. The ribbon cassette as recited in claim 9, wherein said attachment means for securing said partitioning plate to said housing comprises releasable attachment means.

11. The ribbon cassette in accordance with claim 9, wherein said supply roll is located on said rotatable shaft.

12. The ribbon cassette in accordance with claim 11, further comprising a meshing gear disposed within said housing, said meshing gear adapted to cooperate with an external meshing gear, said meshing gear receiving ribbon dispensed by said supply roll and passing said ribbon to said take-up roll, whereby said meshing gears cause the ribbon to be positively advanced without slippage in its passage through the cassette.

13. A ribbon cassette, comprising:

a housing supporting a rotatable shaft for rotation therein;

a supply roll of ribbon in a supply region of said housing and a take-up roll in a take-up region of said housing, both of said rolls being commonly mounted for rotation upon said rotatable shaft, said supply roll dispensing a quantity of ribbon to said take-up roll; and means disposed in said housing adjacent said supply and take-up rolls for changing the path of said ribbon dispensed from said supply roll, whereby said take-up roll stores the dispensed ribbon of said supply roll; and isolating means disposed between said supply and take-up regions of said housing for preventing migration of loose ink particles from said take-up region into said supply region of said housing.

14. The ribbon cassette as recited in claim 13, wherein said isolating means comprises a partitioning plate.

15. The ribbon cassette as recited in claim 14, wherein said partitioning plate comprises attachment means for securing said partitioning plate to said housing.

16. The ribbon cassette as recited in claim 15, wherein said attachment means for securing said partitioning plate to said housing comprises releasable attachment means.

17. The ribbon cassette in accordance with claim 15, wherein said supply roll is disposed on said take-up roll, both of said rolls being integrally formed about said rotatable shaft.

18. The ribbon cassette in accordance with claim 15, further comprising a meshing gear disposed within said housing, said meshing gear adapted to cooperate with an external meshing gear, said meshing gear receiving ribbon dispensed by said supply roll and passing said ribbon to said take-up roll, whereby said meshing gears cause the ribbon to be positively advanced without slippage in its passage through the cassette.

* * * * *